US008662334B2

(12) United States Patent
Turvey et al.

(10) Patent No.: US 8,662,334 B2
(45) Date of Patent: Mar. 4, 2014

(54) VACUUM STORAGE CONTAINER WITH FLEXIBLE DIAPHRAGM

(75) Inventors: Robert R. Turvey, Sanford, MI (US); Brian C. Dais, Saginaw, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 924 days.

(21) Appl. No.: 12/260,230

(22) Filed: Oct. 29, 2008

(65) Prior Publication Data

US 2010/0102058 A1 Apr. 29, 2010

(51) Int. Cl.
*B65D 81/20* (2006.01)

(52) U.S. Cl.
USPC ..... 220/8; 220/203.01; 220/203.29; 220/231; 220/324; 220/360; 220/361; 220/367; 220/373; 220/378; 220/745; 220/806; 206/524.8; 215/260; 215/262; 53/432; 53/510

(58) Field of Classification Search
USPC ..... 220/8, 203.01, 203.29, 231, 324, 361, 220/378, 806, 360, 367, 373, 745; 53/432, 53/510; 206/524.8; 215/260, 262
See application file for complete search history.

(56) References Cited

U.S. PATENT DOCUMENTS

| | | | | |
|---|---|---|---|---|
| 2,040,798 | A | 5/1936 | Schoonmaker | |
| 3,343,701 | A | 9/1967 | Mahoney | |
| 3,370,780 | A | 2/1968 | Shaw | |
| 3,874,963 | A | 4/1975 | Barger | |
| 3,901,405 | A | 8/1975 | Norberg | |
| 4,373,979 | A | 2/1983 | Planeta | |
| 4,374,697 | A | 2/1983 | Tsuzuki | |
| 4,684,033 | A | 8/1987 | Marcus | |
| 4,953,550 | A | 9/1990 | Dunshee | |
| 5,096,078 | A | 3/1992 | McQueeny | |
| 5,121,590 | A * | 6/1992 | Scanlan | 53/510 |
| 5,195,427 | A | 3/1993 | Germano | |
| 5,492,705 | A | 2/1996 | Porchia | |
| 5,554,250 | A | 9/1996 | Dais | |
| 5,779,832 | A | 7/1998 | Kocher | |
| 5,974,686 | A | 11/1999 | Nomura et al. | |
| 5,988,424 | A * | 11/1999 | Kovens | 220/254.3 |
| 6,035,769 | A | 3/2000 | Nomura et al. | |
| 6,835,257 | B2 | 12/2004 | Perrine | |
| 7,096,893 | B2 | 8/2006 | Vilalta et al. | |
| 7,131,550 | B2 | 11/2006 | Vilalta et al. | |
| 7,220,476 | B2 | 5/2007 | Sperry | |
| 2002/0022114 | A1 | 2/2002 | Sorensen | |
| 2003/0213543 | A1 | 11/2003 | Perrine | |
| 2004/0188310 | A1 | 9/2004 | Hamilton | |
| 2004/0206765 | A1 | 10/2004 | McMahon, III et al. | |
| 2006/0032852 | A1 * | 2/2006 | Cai | 220/287 |
| 2006/0118565 | A1 | 6/2006 | Higer | |
| 2007/0007163 | A1 * | 1/2007 | Schlattl et al. | 206/543 |
| 2007/0110343 | A1 | 5/2007 | Buchman | |
| 2008/0041852 | A1 * | 2/2008 | Cai | 220/231 |

FOREIGN PATENT DOCUMENTS

| | | | | |
|---|---|---|---|---|
| EP | 0644128 B1 | | 6/1998 | |
| IT | EP1531132 | * | 8/2004 | B65D 81/20 |

* cited by examiner

*Primary Examiner* — J. Gregory Pickett
*Assistant Examiner* — Elizabeth Volz

(57) ABSTRACT

A vacuum storage container having a container body, a check valve and a lid with an outer rim surrounding a diaphragm. A vacuum pump is engagable with the check valve to remove air from the interior of the container to create a vacuum in the container. The diaphragm is pushed inward by atmospheric forces upon removal of the air until the diaphragm touches and conforms to at least upper exposed surfaces of the contents of the container. The storage container aids in preventing degradation of the contents of the container by maintaining the contents free from the degrading effects of air and by substantially immobilizing the contents during movement of the container to protect the contents from breakage and bruising.

18 Claims, 4 Drawing Sheets

14
18
22
16
10
9
22a
22b
24
12
11
1
8
26

VACUUM STORAGE CONTAINER WITH FLEXIBLE DIAPHRAGM

FIELD OF INVENTION

The present invention relates to a vacuum storage container with a flexible diaphragm. More particularly, the invention relates to a vacuum storage container having a rigid or semi-rigid container body, a check valve, and a lid with a flexible diaphragm as a part thereof. When a vacuum is drawn in the container, i.e., air is removed from beneath the diaphragm, the flexible diaphragm is pushed inward by atmospheric pressure, thereby causing the diaphragm to make contact and substantially conform to the upper or exposed surfaces of the contents of the container. The flexible diaphragm serves, thereafter, as a barrier to exterior air and to substantially immobilize the contents of the container. The essential absence of air in the storage container allows for a longer storage time without degradation of the stored product.

BACKGROUND OF INVENTION

Food items spoil or become damaged when not properly stored. Storage by freezing extends life of food items, but freezer burn diminishes the quality of the frozen food items. The condition of freezer burn generally results from air present in a package of food upon storage or storage of food in non-airtight containers. Food not frozen may also spoil due, in part, to exposure to air, particularly oxygen. Such spoilage represents significant consumer waste and can be avoided by storing the food items in a vacuum sealed container, thereby limiting the food items' exposure to the air.

The quality of stored items may also be greatly diminished if they are damaged during storage. Often during movement of the container and its contents from one place or position to another, the items are moved about inside the container. The items may collide against each other and the walls of the container causing parts of the items to break off or to bruise.

While containers are known which allow a vacuum to be present in the container, these containers do not eliminate the space between the stored items and the lid. As the container as a whole is moved, the contents are also able to move about the inside of the container hitting against each other, the walls, and the lid. Such movement can damage the items, breaking off parts of the items and bruising portions. Such damage degrades the appearance and quality of the food and may increase the amount wasted.

A means readily available and reliable to consumers to create an essentially complete or complete vacuum in a storage container while simultaneously serving to immobilize the stored items is desirable. Ultimately, the packages in the prior art fail to teach a storage container in which a consumer is able to pack and protect items in a storage container using a readily available vacuum suction device.

SUMMARY OF THE INVENTION

The present invention is directed to a vacuum storage container with a lid containing therein a flexible diaphragm. More particularly, the storage container includes a rigid or semi-rigid open top container body, a check valve structured to control the flow of gas therethrough, and a lid having a flexible diaphragm. The check valve is present in the lid at any position allowing access by the valve to the storage area of the container. Preferably the check valve is near the perimeter of the diaphragm which allows the use of either a flexible or rigid check valve. However, if a flexible check valve is used, the valve can be in the center or elsewhere in the flexible diaphragm since the flexible nature of the valve allows the valve to conform to the diaphragm as it changes shape. The flexible diaphragm is an elastomeric material, wherein the material is preferably gas impermeable. In use, the lid is sealingly secured to the container body, a vacuum is drawn within the container through the check valve using a vacuum pump, preferably hand-held. As a result of differential pressures, i.e., pressure inside the container upon removal of air as compared to the external atmospheric forces, the diaphragm extends inward. When a vacuum is drawn on the storage container, the diaphragm is inwardly extended and in contact with the upper or exposed surfaces of the contents and serves to substantially immobilize the contents of the container. Such immobilization serves to prevent the contents stored in the container from becoming damaged. Further, the vacuum, i.e., absence of air, assists in extending storage time and, upon freezing, the prevention of freezer burn for an extended time.

The detachable lid of the invention includes an outer rim constructed of rigid or semi-rigid material which surrounds a flexible diaphragm. The check valve is preferably present in the flexible diaphragm of the lid, more preferably, located near the perimeter of the diaphragm and proximal to the outer rim of the lid. The diaphragm is preferably constructed of an elastomeric sheet material, more preferably a gas impermeable elastomeric material. The lid is structured to engage an upper rim of the open top of the container body so as to create an airtight seal thereby allowing for the creation of a vacuum within the container. Preferably the outer rim of the lid and upper rim of the container body are complementarily structured to provide a secure mating seal therebetween. Any conventional mating closure structure which provides a seal as described is suitable for use. However, engagement of the lid to the container may be of any known structure which allows the flexible diaphragm and valve to operate in accordance with the present invention. The outer rim of the lid preferably includes a horizontal inwardly extended portion of the rigid or semi-rigid material to allow stacking of the containers.

The check valve is a mechanical device or valve that allows a gas, e.g., air, to flow therethrough in a controlled manner. A one-way check valve is adequate for use since to draw a vacuum, the air within the container only needs to be pulled out or exhausted. One-way check valves as conventionally known are suitable for use, such as a diaphragm check valve, ball check valve, swing check valve, or any other appropriate check valve structure. As set forth above, the check valve is preferably present in the lid to provide for the most efficient evacuation of air from throughout the container. The check valve can also be in the form of an adhesive valve situated anywhere in the flexible diaphragm. The adhesive and flexible nature of this type of valve allows conformance of the valve to the shape of the flexible diaphragm as the diaphragm extends inward into the storage area of the container.

The placement of the check valve in the lid also provides for a more cost effective and versatile structure. The vacuum lid can be used with any container body that has a complementary upper rim structure, i.e., structured to provide sealing therewith. Thus, if a container body is disposed of for any reason, e.g. food discoloration or other age or use related damage or simple loss, the lid may be used with another container body. Alternatively, the check valve may be present in a wall of the container body, preferably proximal to the upper rim. In the alternative embodiment, when useful life of the lid is complete, replacement lids may be provided at a lesser cost.

The vacuum-drawing device is structured to extract air from the interior of the container through the check valve. The vacuum-drawing device may be manual or automatic, e.g., battery or electric operated. Preferably the vacuum device is hand-held and, more preferably a hand-held battery-operated device. In use, the vacuum device mounts or attaches to the check valve and extracts the air present in the interior area of the container to thereby create a vacuum within the container.

In operation, items to be stored are placed within the body of the container. The lid is structured to have a mating or complementary fastening structure with the upper rim of the container body so that when the lid is operatively positioned on the container body, an airtight seal is created. A vacuum is then drawn within the container interior by the vacuum device removing air through the check valve. As a vacuum is created within the container, atmospheric pressure acts upon the diaphragm of the lid causing the diaphragm to be pushed inward. The diaphragm is pushed inward into the interior area of the container body until it comformingly contacts the upper or exposed surfaces of the contents of the container and/or an interior surface of the container body itself. Thus, the air is displaced from the interior of the container and the diaphragm renders the contents essentially immobile, each serving to protect the contents from degradation during storage.

The shape and size of the container may necessarily vary in order to accommodate contents of different volumes or sizes. The container is preferably made of a plastic material, which may be disposable or permanent in nature.

BRIEF DESCRIPTION OF THE DRAWINGS

FIG. 9 illustrates the effect of the differential forces acting upon the diaphragm. The differential forces serve to push the diaphragm inward so that the diaphragm contacts the exposed surfaces of the contents and interior walls of the container body.

DETAILED DESCRIPTION OF THE PREFERRED EMBODIMENTS

Figures 1, 2, 3, 4, 5:
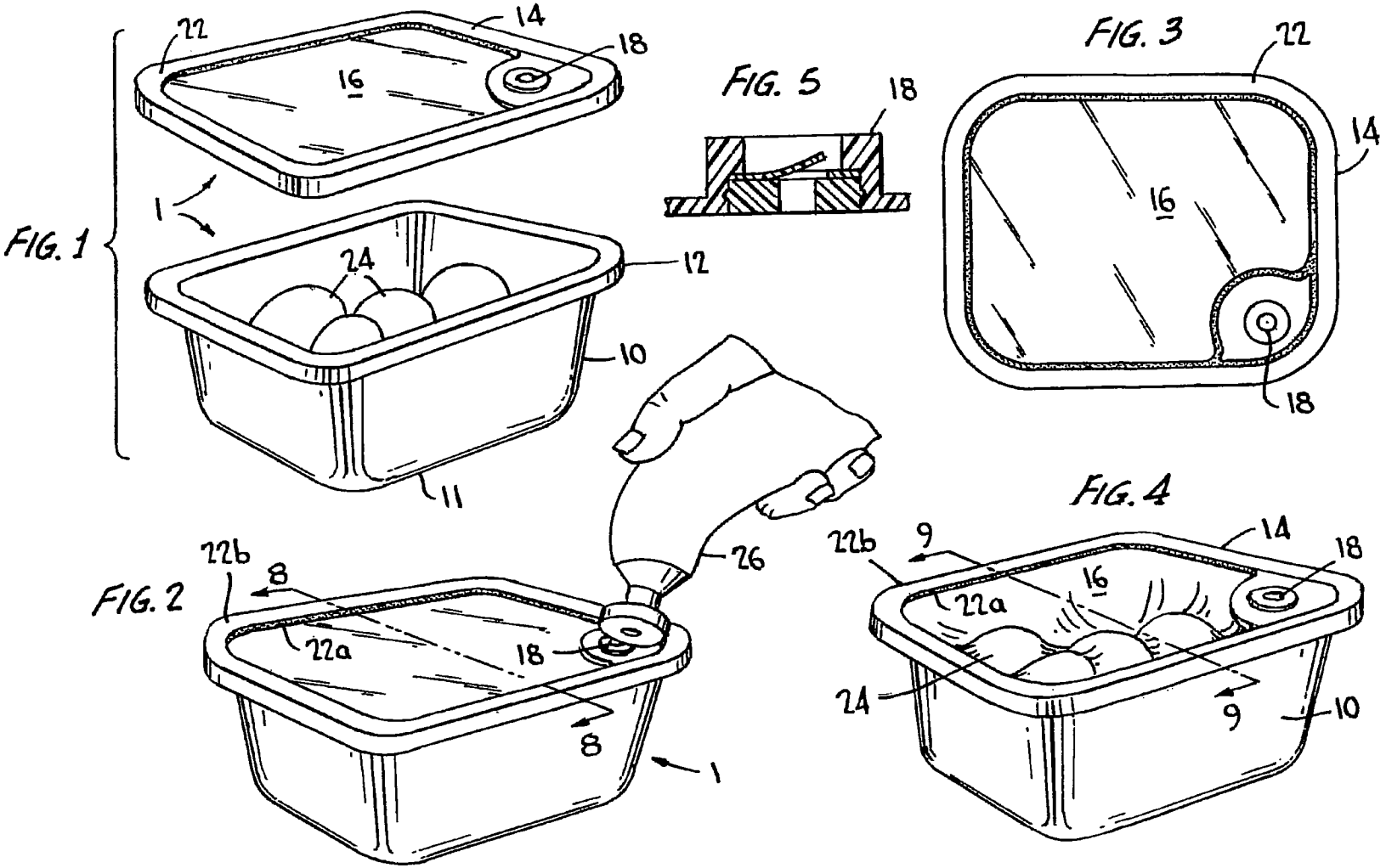
FIG. 1 is an exploded perspective view of a preferred embodiment of the container of the invention.
FIG. 2 is a perspective view of the embodiment of the container of FIG. 1 with the lid in place on the container body.
FIG. 3 is a top plan view of the container lid of FIG. 1.
FIG. 4 is a perspective view of the embodiment of FIG. 1 following the drawing of a vacuum inside the container and having the diaphragm in contact with the container contents.
FIG. 5 is a cross-sectional view of one embodiment of a check valve suitable for use.

As shown in FIGS. 1-14, the invention relates to a vacuum storage container 1 which includes a container body 10, check valve 18, and a lid 14 with a flexible diaphragm 16.

The container body 10 has a base wall and peripheral or side walls extending to an open top or mouth. The container may be of varying shapes, e.g. square, rectangular, circular, etc. The container body 10 is constructed of a rigid or semi-rigid material, such that the body maintains its essential shape when subject to differential pressures as occur in the practice of the container of the invention. Plastics known in the art for making plastic food containers are suitable for use as the container body. The container body is preferably thermally molded from a thermoplastic material, for example, polypropylene, polyethylene, polycarbonate, or other thermoplastics suitable for use as disposable or durable containers. The container body 10 has an upper rim 12 surrounding the top opening of the container body. The structure of the rim can be any appropriate structure suitable for providing a seal with a complementary structure in the lid when the lid is operatively placed on the container body. Preferably, a snap-fit mating rim structure is used. Such a snap-fit mating rim structure provides closure upon placement of a downward pressure on the lid rim when it is seated on top of the upper rim of the container body. The lid can be removed upon an upward lifting of the lid rim which breaks the closure seal. The mating rim structure is preferably sized to allow easy grasping thereof by a user. The outer rim 22 preferably has a horizontal inward extension 22*a* projecting from the base of the sealing portion 22*b* to provide a depressed area. The extension 22*a* is sized to allow stacking of containers, i.e., the base wall 11 can sit on extension 22*a*.

The container lid 14 includes a flexible diaphragm 16. A rigid or semi-rigid outer rim 22 surrounds the diaphragm 16. The lid, and preferably outer rim 22, is constructed such that it engages with the rim 12 of the container body 10 as described above such that an airtight seal is formed therebetween. The outer rim of the lid may be made of plastic material such as that from which the container body is made. In any event, the outer rim of the lid, whether mating to an upper rim of the container body or extending therebeyond with sealing being provided by the film also forming the flexible diaphragm, is rigid or semi-rigid in nature to withstand shape deformation when a vacuum is drawn on the interior area of the container. The flexible diaphragm is made of a suitable elastomeric material which allows deformation inward and conformation to other surfaces when air is removed from beneath the flexible diaphragm in the interior of the container exposing the diaphragm to the effects of atmospheric pressure. Elastomeric materials suitable for use in making the diaphragm have the ability to deform elastically when under stress, e.g., application of an external force thereon, but then return essentially to its original shape when the stress is removed. Elastomeric materials suitable for use as the flexible diaphragm preferably have non-permanent deformation, i.e., when in a relaxed state, stress is not present in the diaphragm. Examples of elastomeric materials for use in disposable containers are plastic materials that can be stretched about 1½ times their length without permanent deformation. Permanent deformation is understood to mean that the material does not return to its original state. Necessarily if the flexible diaphragm is for a one-time disposable use, a plastic having permanent deformation could be used. Elastomeric materials suitable for use in making durable containers, i.e., re-useable and lasting through manual and machine washings, can be stretched about 1½ to about 2½ times their length without permanent deformation. Preferred examples of elastomeric materials suitable for use as the flexible diaphragm include low density polyethylenes, such as commercially available under the name DOW Affinity Polyolefin Resins.

Figure 10:
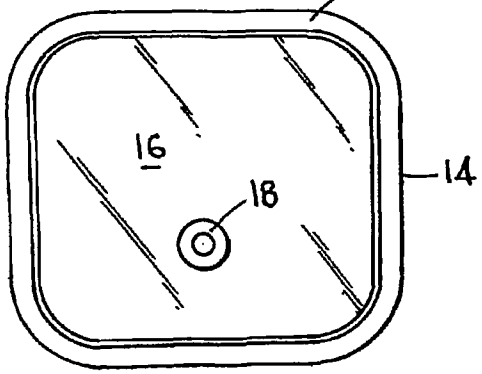
FIG. 10 is a top plan view of an alternative embodiment of a container lid.

The preferential structure of the container lid 14 includes a check valve 18 located therein either proximally to the outer rim 22 as shown in FIGS. 1 and 2 or, when the check valve is flexible, in the flexible diaphragm in the area positioned above the container storage area, for example as shown in FIG. 10. In the embodiment shown in FIG. 10, the flexible check valve is preferably an adhesive valve, such as commercially sold by Pliatech. The valve is easily attached to the flexible diaphragm by (1) punching a hole in a desired location in the flexible diaphragm, and (2) inserting the valve in the hole. The valve pulls down in conformity with the diaphragm when a vacuum is provided in the interior of the container due to the flexible nature of the valve structure. Alternatively, the check valve can be present in the container body 10. The check valve is preferably a one-way check valve and can be of any suitable structure which serves the purpose of a one-way valve to facilitate the creation of a vacuum within the container, such as a lift-check valve, clapper valve, swing check valve, ball check valve, or the like. Placement of the check valve in the lid serves to provide a substantially uniform upward removal of air from the interior of the container and, thereby, an inverse downward movement of the flexible diaphragm into the container body.

Figure 7:
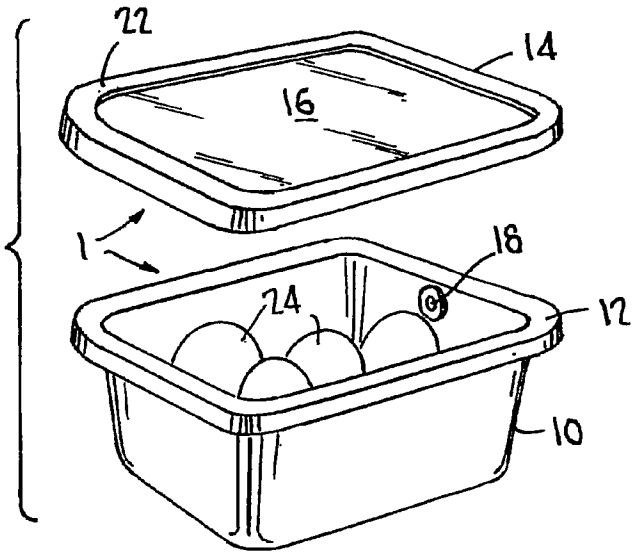
FIG. 7 is an exploded perspective view of an alternative embodiment of the storage container wherein the check valve is a component of an end wall of the container body.
Figure 6:
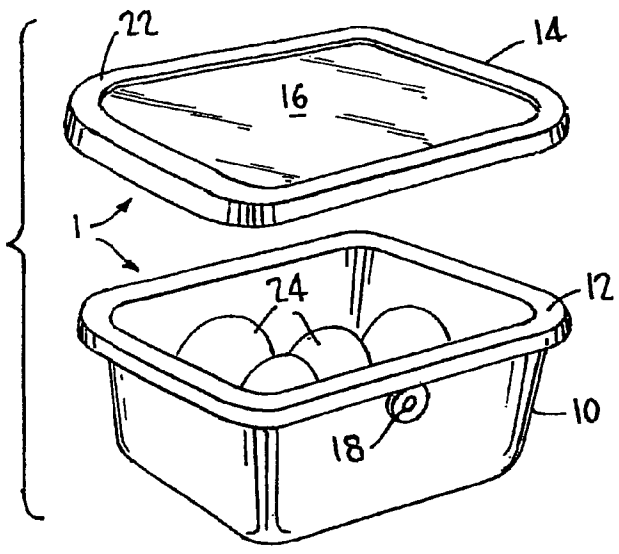
FIG. 6 is an exploded perspective view of an alternative embodiment of the storage container wherein the check valve is a component of a side wall of the container body.
Figure 9:
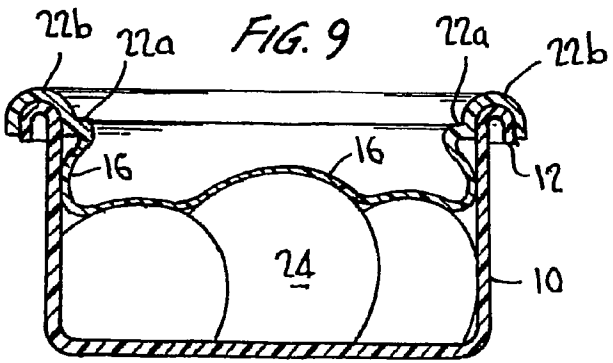
FIG. 9 is a cross-sectional view taken along line 9-9 of FIG. 4 showing the container lid sealingly secured to the container body after a vacuum is drawn in the container.
Figure 8:
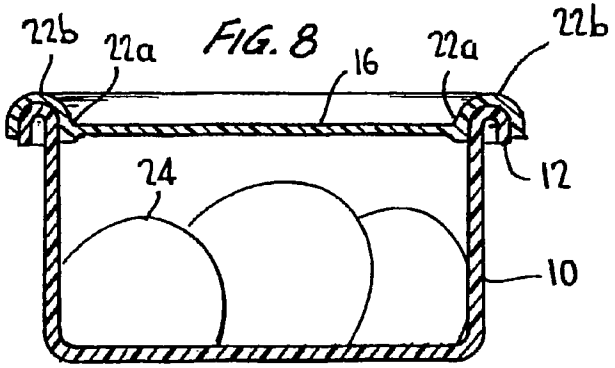
FIG. 8 is a cross-sectional view along line 8-8 of FIG. 2 showing the container lid sealingly secured to the container body before a vacuum is drawn in the container.

In an alternative embodiment, the check valve 18 can be present as a component of the container body 10 as shown in FIGS. 6 and 7, e.g. placement in an end wall or side wall of the container body, preferably in an upper portion thereof. The structure of the check valve can be other than that illustrated in FIG. 5. Any valve structure which serves the function of readily drawing a vacuum by pulling air from the interior area of the container is suitable for use.

Vacuum pumps suitable for use can be manual or automatic, e.g. battery or electric operated. The preferred vacuum pump is hand held, either manual or battery operated, which allows for ready use and storage. Hand-held manual and battery operated vacuum pumps suitable for use are commercially available and sold under the names Ziploc® as to a manual vacuum pump and Reynolds® Handi-Vac as to a battery-operated pump.

In operation, items 24 to be stored are placed into the container body 10 and the container lid 14 is sealingly secured to the container body 10. In the embodiment illustrated in FIGS. 1-9, the outer rim 22 of the lid 14 engages the upper rim 12 of the container body 10 to create an airtight seal therebetween. After the container lid is secured to the container body, a vacuum device 26 is engaged with the check valve 18. The vacuum device 26 removes the air inside the container to create a vacuum within the container. As the vacuum is drawn inside the container, the differential pressure between the vacuum in the interior area of the container and the external atmospheric pressure causes the diaphragm 16 to expand inward into the interior area. The inwardly expanding diaphragm 16 contacts the upper or exposed surfaces of the contents 24 and the interior walls of the container body 10 rendering the contents essentially immobile.

When the user wants access to the contents stored in the container, a portion of the rim of the lid is lifted thereby breaking the vacuum and allowing removal of the lid. The diaphragm relaxes and returns to its original configuration so that the diaphragm is no longer extending inward and the contents of the container can be removed.

Figure 11:
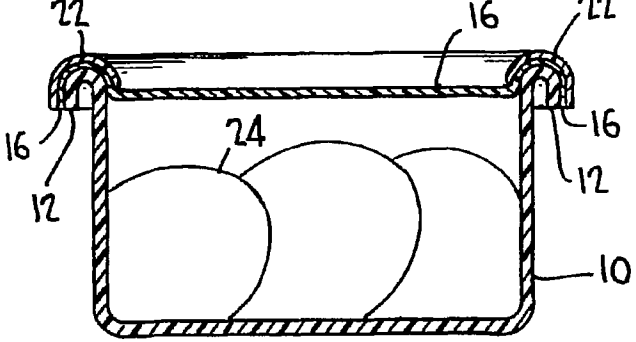
FIG. 11 is a cross-sectional view similar to FIG. 8 but showing an alternative embodiment where the film providing the flexible diaphragm extends over the upper rim of the container and forms of seal therewith.
Figure 12:
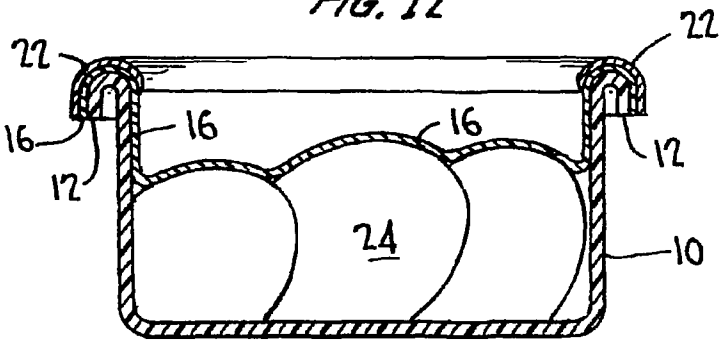
FIG. 12 is a cross-sectional view as in FIG. 11 after a vacuum is drawn in the container and the flexible diaphragm is pushed inward to contact the interior wall of the container and the upper or exposed surfaces of articles present in the interior of the container.
Figure 13:
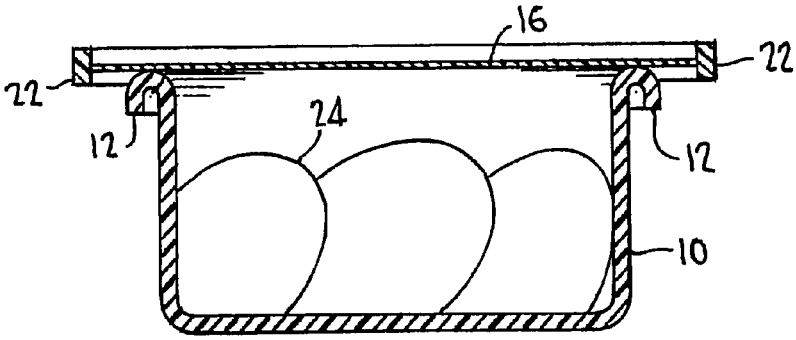
FIG. 13 illustrates another embodiment of a lid where the film providing the flexible diaphragm extends over the upper rim of the container.
Figure 14:
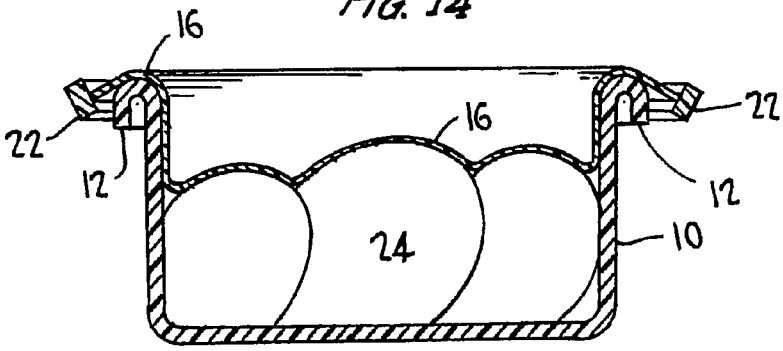
FIG. 14 illustrates the embodiment of FIG. 13 after a vacuum is drawn in the storage area of the container and the film of the flexible diaphragm extends over the upper rim of the container forming a seal therewith.

With respect to the embodiments illustrated in FIGS. 11-14, operation is essentially the same as with the embodiments of FIGS. 1-10. The difference is in the sealing between the lid 14 and the upper rim 12 of the container. In FIGS. 11-12, the lid includes a rigid or semi-rigid outer rim portion 22 having the elastomeric film of the flexible diaphragm 16 extending under the outer rim 22 to provide the contact or sealing surface with upper rim 12. In the embodiment of FIGS. 13-14, the outer rim 22 of lid 14 extends beyond the upper rim 12 and the elastomeric film forming the flexible diaphragm 16 seals with and conforms to the upper rim 12 when a vacuum is drawn on the interior of container 10.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A storage container for use with a vacuum packaging appliance, said storage container comprising:

a container body with a base wall, side walls, an open top and an upper rim surrounding the open top;

a one-way check valve structured to control a flow of a gas therethrough; and a lid comprising as a single unit a flexible diaphragm and an outer rigid or semi-rigid rim surrounding said diaphragm, wherein said outer rim is complementarily structured to said upper rim of said container to releasably seal said outer rim to said upper rim and said lid provides an airtight interior area in said container body; and wherein said lid is constructed and arranged so that, when said lid is operatively present on said container body, said flexible diaphragm is deformable inward into said interior area, when gas in said interior area is removed through said one-way check valve, to such an extent so as to substantially conform the flexible diaphragm to exposed upper surfaces of contents in said container body.

2. The storage container according to claim 1, wherein said flexible diaphragm extends under said outer rim so as to provide a contact for said outer rim for sealing with said upper rim when said lid is operatively engaged with said upper rim.

3. The storage container according to claim 1, wherein said container body comprises a rigid or semi-rigid plastic material.

4. The storage container according to claim 1, wherein said outer rim includes a sealing portion and a horizontal inward extension projecting from said sealing portion on one end and connected to said flexible diaphragm on an opposite end.

5. The storage container according to claim 1, wherein said elastomeric material is stretchable about 1½ to about 2½ times its length without permanent deformation.

6. The storage container according to claim 1, wherein said check valve is a component of said lid.

7. The storage container according to claim 6, wherein said check valve is located proximal to the outer rim of the lid.

8. The storage container according to claim 6, wherein said check valve is a flexible valve.

9. The storage container according to claim 1, wherein said diaphragm comprises an elastomeric material.

10. The storage container according to claim 9, wherein said elastomeric material is gas impermeable.

11. The storage container according to claim 9, wherein said elastomeric material comprises low density polyethylene.

12. An integral lid for a vacuum storage container comprising as a single unit:

a central portion comprising a flexible diaphragm;

an outer rim surrounding the flexible diaphragm, said outer rim comprising a rigid or semi-rigid material and being constructed as a first half of a complementary structure wherein a second half is an upper rim of container side walls so that said outer rim provides an airtight closure seal with said upper rim; and a one-way check valve positioned in said flexible diaphragm;

wherein said flexible diaphragm comprises an elastomeric material which is non-permanently deformable when subjected to differential pressures on opposite sides of said flexible diaphragm, and is deformable outward from a bottom side of said lid and will remain as such while subjected to said differential pressures.

13. The lid for a vacuum storage container according to claim 12, wherein said check valve is a flexible valve.

14. The lid for a vacuum storage container according to claim 12, wherein said check valve is rigid and located proximal to a perimeter of said flexible diaphragm.

15. The lid for a vacuum storage container according to claim 12, wherein said outer rim comprises a plastic material of greater rigidity than said elastomeric material, said rigidity being such that said outer rim substantially retains shape when subjected to differential pressures on opposite sides thereof.

16. The lid for a vacuum storage container according to claim 12, wherein the elastomeric material comprises low density polyethylene.

17. The lid of a vacuum storage container according to claim 12, wherein said outer rim includes a sealing portion which optionally includes an extension of said flexible diaphragm which forms a contact surface to an underside of said outer rim for sealing with said upper rim.

18. The lid of a vacuum storage container according to claim 12, wherein said elastomeric material is stretchable about 1½ to about 2½ times its length without permanent deformation.

* * * * *